United States Patent [19]

Hoekstra, deceased

[11] 4,425,967

[45] Jan. 17, 1984

[54] IGNITION PROCEDURE AND PROCESS FOR IN SITU RETORTING OF OIL SHALE

[75] Inventor: Gerald B. Hoekstra, deceased, late of South Holland, Ill., by Edith Hoekstra, executrix

[73] Assignee: Standard Oil Company (Indiana), Chicago, Ill.

[21] Appl. No.: 309,274

[22] Filed: Oct. 7, 1981

[51] Int. Cl.[3] ..... E21B 43/243; E21B 36/02

[52] U.S. Cl. ..... 166/259; 166/59; 299/2

[58] Field of Search ..... 166/259–261, 166/59, 60; 299/2

[56] References Cited

U.S. PATENT DOCUMENTS

| | | | |
|---|---|---|---|
| 3,400,762 | 9/1968 | Peacock et al. | 166/259 X |
| 3,521,709 | 7/1970 | Needham | 166/259 X |
| 3,661,423 | 5/1972 | Garret | 299/2 |
| 3,952,801 | 4/1976 | Burton | 166/59 X |
| 4,005,752 | 2/1977 | Cha | 299/2 |
| 4,027,917 | 6/1977 | Bartel et al. | 166/259 X |
| 4,126,180 | 11/1978 | Cha | 166/259 X |
| 4,191,251 | 3/1980 | Cha | 166/260 |
| 4,245,701 | 1/1981 | Chambers | 166/59 X |
| 4,301,866 | 11/1981 | Burton et al. | 166/260 |

*Primary Examiner*—Ernest R. Purser
*Assistant Examiner*—Thuy M. Bui
*Attorney, Agent, or Firm*—Thomas W. Tolpin; William T. McClain; William H. Magidson

[57] ABSTRACT

An in situ process and ignition procedure are provided to retort oil shale which increases product yield and enhances uniformity of the flame front in an underground retort. In the process, a portion of the rubblized mass of oil shale is preheated with steam, nitrogen or some other inert gas, to at least the minimum oil shale ignition temperature and preferably retorted. Thereafter, the preheated oil shale is ignited with hot excess air or some other oxygen-containing gas above the maximum desired retorting temperature to establish a generally uniform flame front across the retort. In the preferred form, the preheating gas and oxygen-containing gas are introduced into the retort at different times from the same specially configured downhole burner.

11 Claims, 4 Drawing Figures

GASEOUS FUEL
AIR
FEED GAS
PREHEATING GAS
IGNITION GAS
DOWNHOLE BURNER
SPENT SHALE
COMBUSTION ZONE
FLAME FRONT
RETORTED SHALE
RETORTING ZONE
GASES
OIL
WATER
10
12
14
16
18
20
22
24
26
28
30
32
34
42
46
48
50
52
54
56
58
60
62
68
70
72
74
76
80
84
86
88
89
90
91
92
93
94

IGNITION PROCEDURE AND PROCESS FOR IN SITU RETORTING OF OIL SHALE

BACKGROUND OF THE INVENTION

This invention relates to an ignition procedure and process for underground retorting of oil shale.

Researchers have now renewed their efforts to find alternative sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be effectively recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

In order to obtain high thermal efficiency in retorting, carbonate decomposition should be minimized. Carbonate decomposition consumes heat, lowers thermal efficiency and decreases the heating value of off gases. Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In situ retorts require less mining and handling than surface retorts.

In in situ retorts, a flame front is continuously passed downward through a bed of rubblized oil shale to liberate shale oil, off gases and residual water. There are two types of in situ retorts: true in situ retorts and modified in situ retorts. In true in situ retorts, the oil shale is explosively rubblized and then retorted. In modified in situ retorts, some of the oil shale is removed before explosive rubblization to create a cavity or void space in the retorting area. The cavity provides extra space for rubblized oil shale. The oil shale which has been removed is conveyed to the surface and retorted above ground.

Flame fronts often become nonuniform upon ignition, so that the flame front does not extend fully or evenly across the retort, or becomes tilted, nonhorizontal, or irregular, or has fingers or projections of high temperature which extend downward into the raw oil shale and advance far ahead of other portions of the flame front. Nonuniform flame fronts often have excessively high temperatures and many deleterious effects. Excessively high temperatures and fingering can cause carbonate decomposition, coking and thermal cracking of the liberated shale oil. Nonuniform flame fronts can lead to flame front breakthrough, incomplete retorting and burning of the product shale oil. If a narrow portion of the flame front advances completely through the retorting zone, it can ignite the effluent oil and off gases and may cause explosions. It has been estimated that losses from burning in in situ retorting are as high as 40% of the product shale oil.

Numerous processes have been developed for in situ retorting of oil shale and igniting in situ retorts. Typifying these processes are those found in U.S. Pat. Nos. 3,952,801; 4,005,752; 4,027,917; 4,105,172; 4,169,506; 4,126,180; 4,133,380; 4,147,389; 4,153,110; 4,191,251; 4,191,252; 4,192,381; and 4,245,701. These prior art processes have met with varying degrees of success.

It is, therefore, desirable to provide an improved process for in situ retorting of oil shale and igniting underground retorts.

SUMMARY OF THE INVENTION

An improved in situ process and ignition procedure is provided to retort oil shale which increases product yield and enhances uniformity of the flame front. The process is dependable, effective and particularly advantageous for use in modified in situ retorts.

In the novel process, a portion of a rubblized mass of oil shale in an underground retort is preheated with an inert gas, such as steam, nitrogen, off gases emitted from the retort or other gases containing an insufficient amount of molecular oxygen to support combustion, to above the oil shale ignition temperature of 650° F. and preferably above the minimum oil shale retorting temperature of 750° F. Thereafter, the preheated portion of the rubblized mass is ignited with a flame front-supporting gas, such as hot excess air, to establish a generally uniform flame front across the retort. To attain the desired results, the preheating gas is injected at a temperature greater than 650° F., preferably from 900° F. to 1200° F. and most preferably at about 950° F. The flame front-supporting gas is injected at a temperature at least as great as the maximum desired retorting temperature, preferably from 900° F. to 1200° F., and most preferably about 950° F.

The intention of the preheating step is to heat part or all of the top of the rubblized bed to its ignition temperature for subsequent ignition when air or another flame front-supporting gas is introduced. Desirably, a substantial depth or thickness of the rubblized mass, such as four foot layer or more, is retorted at a retorting temperature from 750° F. to 900° F., with a hot inert gas to liberate hydrocarbons leaving retorted shale containing residual carbon. The residual carbon serves as fuel for the flame front.

The ignition step establishes a flame front and assures that ignition will occur at least underneath the burner in the event that ignition is prevented from occurring elsewhere because of cooling due to excess water influx or roof collapse.

The combination of the preheating step, or retorting step, with the ignition step provides more effective retorting with higher product yields than the use of either step alone. Retorting with an inert gas alone in the absence of air and without a subsequent flame front usually results in higher costs and gas temperatures and decreases efficiency and product yield in comparison to the novel process of this invention.

When ignition is initiated without preheating, nonuniform flame fronts often occur as the flame front spreads. When ignition is initiated after preheating, but with a relatively cold ignition gas, such as ambient air or some other oxygen containing gas substantially below the shale oil ignition temperature, ignition typically takes place only in those areas which are not cooled by influx of ground water into the retort. If ground water flow is substantial as often occurs with retorts located in an underground aquifier, ignition results in severely nonuniform flame fronts. Inflow of ground water into an underground retort, can be quite significant, such as 5½ to 30 gal/min, with underground streams of water dripping into the rubblized mass and cooling the oil shale.

Advantageously, the combination of steps provided in this inventive process assures that ignition occurs at locations preheated to at least the oil shale ignition temperature.

While the preheating gas and ignition gas can be introduced separately from various locations, such as from aboveground, it is preferred that the preheating and ignition gases are introduced from the same downhole burner strategically positioned in an empty space or void located slightly above the top layer of rubblized shale, beneath the retort's roof, for enhanced effectiveness. In the preferred form, both the preheating gas and the ignition gas are emitted at different times from an outer annular portion of a specially configured downhole burner with concentric nozzles or ejectors and a set of longitudinally offset baffles. A pilot light sustained by air and gaseous fuel, such as methane, is ignited in the inner nozzle during preheating to heat the preheating gas to the desired preheating temperature.

Satisfactory ignition of the flame front can be detected by monitoring the composition of the off gases emitted from the retort. Once satisfactory ignition of the flame front has been established, the flame-front supporting gas is replaced by a feed gas to sustain and drive the flame front downwardly through the retort according to the selected retorting procedure.

The feed gas can be emitted from a separate borehole nozzle, preferably positioned about the periphery of the retort, or from the downhole burner. The feed gas can be air, air enriched with oxygen, or air diluted with steam or recycled off gases, as long as the feed gas has at least 5%, preferably from 10% to 30% and most preferably a maximum of 20% by volume molecular oxygen.

As used throughout this application, the term "inert gas" means a gas having less than a sufficient amount of molecular oxygen to sustain combustion.

The terms "preheating gas" and "retorting gas" as used herein mean an inert gas.

The terms "ignition gas," "flame front-supporting gas," "combustion-supporting gas," or "combustion-sustaining gas" as used herein mean a gas containing a sufficient amount of molecular oxygen to support combustion.

The term "retorted" shale refers to oil shale which has been retorted to liberate hydrocarbons leaving an organic material containing residual carbon.

The term "spent" shale as used herein means retorted shale from which all of the residual carbon has been removed by combustion.

A more detailed explanation of the invention is provided in the following description and appended claims taken in conjunction with the accompanying drawings.

DETAILED DESCRIPTION OF THE PREFERRED EMBODIMENT

Figure 1:
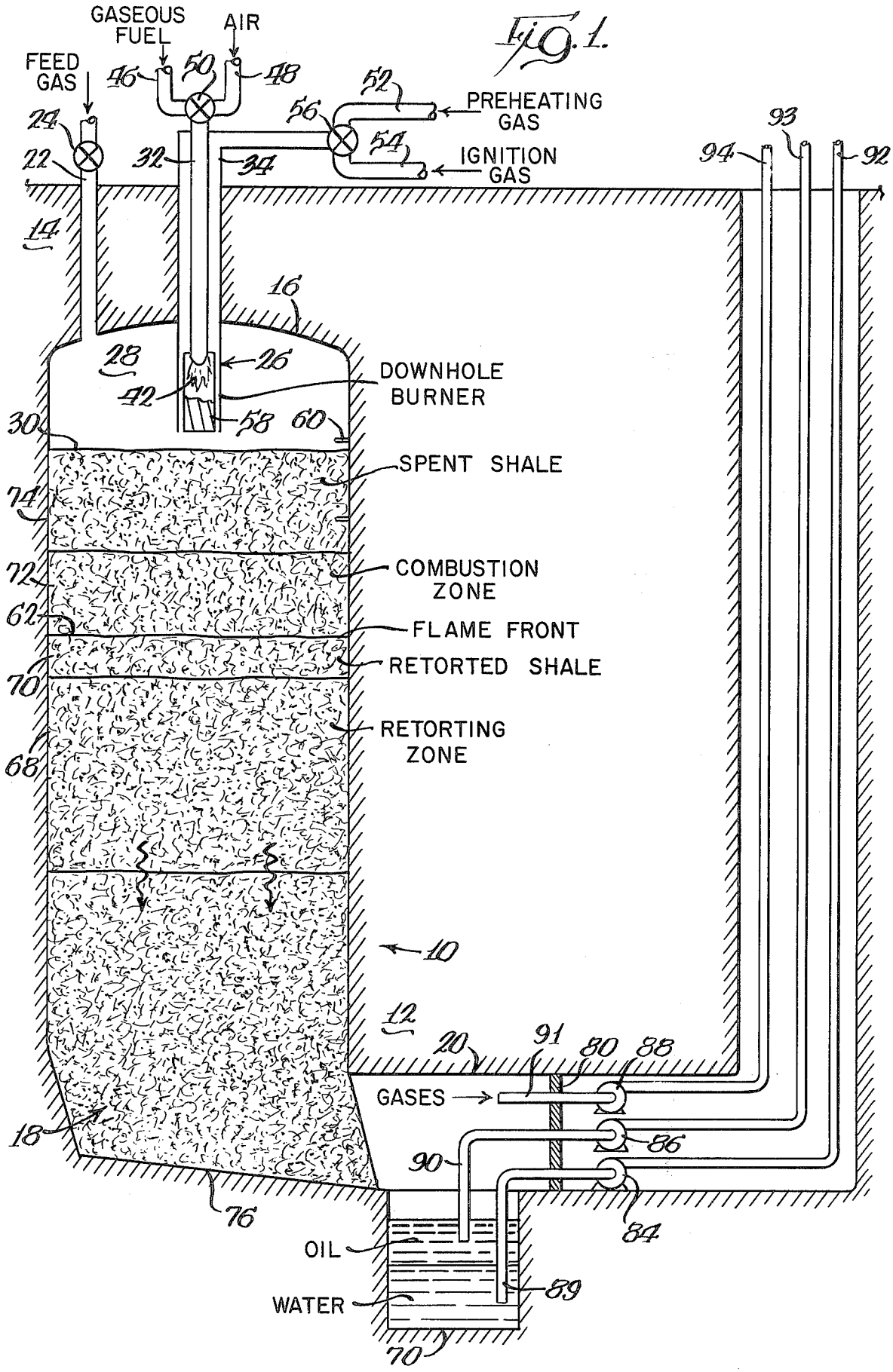
FIG. 1 is a schematic cross-sectional view of a modified in situ retort for carrying out a process in accordance with principles of the present invention.

Referring now to the drawing, an underground, modified in situ, oil shale retort 10 located in a subterranean formation 12 of oil shale is covered with an overburden 14. Retort 10 is elongated, upright, and generally box-shaped, with a top or dome-shaped roof 16.

Retort 10 is filled with an irregularly packed, fluid permeable, fragmented, rubblized mass or bed 18 of oil shale spaced below roof 16. The rubblized mass is formed by first mining an access tunnel or drift 20 extending horizontally into the bottom of retort 10 and removing from 2% to 40% and preferably from 15% to 25% by volume of the oil shale from a central region of the retort to form a cavity or void space. The removed oil shale is conveyed to the surface and retorted in an aboveground retort. The mass of oil shale surrounding the cavity is then fragmented and expanded by detonation or explosives to form the rubblized mass 18.

A conduit or pipe 22 provides a feed gas line that extends from above ground level through overburden 14 into the top 16 of retort 10. The extent and rate of gas flow through line 22 is regulated and controlled by feed gas valve 24.

A centrally positioned downhole burner 26 extends axially from above the ground level through overburden 14 into the void space or chamber 28 between the roof 16 and the top 30 of the rubblized mass 18 of oil shale to a position closely adjacent and in proximity to the top of the rubblized mass.

Figure 2:
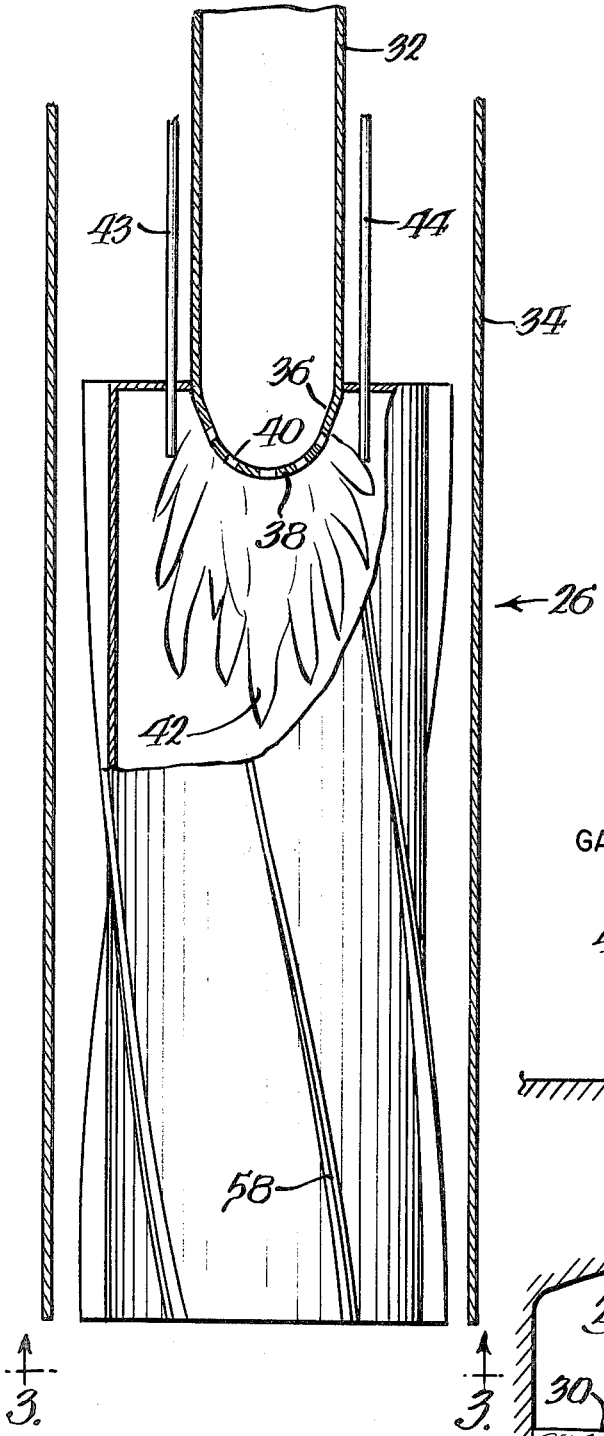
FIG. 2 is an enlarged front view of a downhole burner for use in the process.
Figure 3:
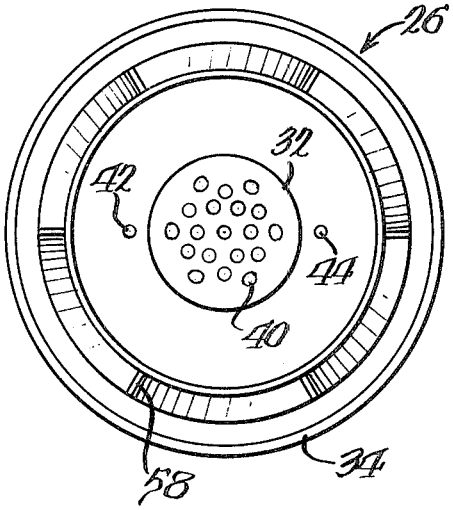
FIG. 3 is a cross-sectional view of the downhole burner taken substantially along line 3—3 of FIG. 2.

As best shown in FIGS. 2 and 3, downhole burner 26 has a pair of concentric nozzles or ejectors 32 and 34 including an inner central nozzle or ejector 32 and an outer annular nozzle or ejector 34 diametrically positioned about inner nozzle 32. Inner nozzle 32 has an inwardly tapered or flared outlet throat 36 which can be covered by a foraminous, semispherical or curved cap 38. Cap 38 has holes or apertures 40 for egress of the pilot light 42 and emission of heat and hot gases. A spark head or electrical igniters 43 and 44 is positioned slightly outwardly of cap 38 and inner nozzle 32 to initiate a spark to light the mixture of gaseous fuel and air so as to form a downwardly projecting, pilot light or flame 42 during preheating. Inner nozzle 32 should have sufficient volume to accommodate complete combustion and a sufficient cross-sectional area to maintain stability of the pilot light.

Inner nozzle 32 is fed a mixture of gaseous fuel from gaseous fuel line 46 (FIG. 1) and air or some other combustion-sustaining gas from air line 48 through mixing valve 50. The proportion of gaseous fuel to air and flow rate is regulated by mixing valve 50, so that essentially all the air is consumed by the pilot light 42, with less than 0.5% and preferably only 0.1% to 0.3% by volume, excess air in the pilot light-flue gas. In some circumstances it may be desirable to first mix the gaseous fuel and air in throat 36 by extending the gaseous fuel line and air line down to the throat and regulating each line by a separate valve.

Outer nozzle 34 extends below inner nozzle 32 and circumferentially surrounds inner nozzle 32 to form an annular discharge opening therebetween. During the preheating step, outer nozzle 34 is fed an inert preheating gas, sometimes referred to as a "retorting gas," through preheating gas line 52. During the ignition step, outer nozzle 34 is fed an oxygen-containing ignition gas, also referred to as a "flame front-supporting gas" or a "combustion-supporting gas," through ignition gas line 54. The quantity and rate of preheating gas and ignition gas flowing through outer nozzle 34 are regulated by control valve 56.

A series of baffles or vanes 58 (FIG. 2), which are longitudinally offset by 60° from end to end, are welded or otherwise secured to the outside of inner nozzle 32. Baffles 58 extend downwardly and enhance turbulent mixing of the preheating gas with heat and hot combustion (flue) gases emitted from pilot light 42 during preheating.

The preferred inert preheating gas is steam, although other inert gases can be used as the preheating gas such as nitrogen or off gases emitted from the retort. While the preferred ignition gas is air, other gases containing at least 5%, preferably from 10% to 30% and most preferably a maximum of 20% by volume molecular oxygen can be used as the ignition gas.

The gaseous fuel preferably consists of methane, although other gaseous fuels such as off gases emitted from the retort can be used to fuel the pilot light. Shale oil can also be used in lieu of a gaseous fuel.

In operaton, pilot light 42 is ignited to heat the retorting gas to at least 650° F., preferably to 900° F. to most effectively retort the oil shale. The retorting gas is discharged from outer nozzle 34 onto the top layer 30 of the rubblized mass 18 of oil shale, to at least an oil shale ignition temperature of 650° F. The temperature in the bed 18 can be detected by numerous thermometers 60 located throughout the retort. Preferably, at least several feet, and most preferably a four foot thickness or depth of the top layer or seam 30 is preheated to a retorting temperature from 750° F. to 900° F. to liberate hydrocarbons leaving retorted shale containing carbon residue. Retorting of oil shale generally commences at 750° F. and is completed at 900° F. The residual carbon serves a fuel during ignition.

The preheating gas is directed downward from outer nozzle 34 at a flow rate of 2 SCFM/ft$^2$ to 3 SCFM/ft$^2$. The preheating gas can also be directed downward at a lower temperature prior to termination to cool roof 16 below its ignition temperature so as to minimize spalling of the roof. The preferred lower temperature is about 250° F. with the preheating gas being directed downwardly at the lower temperature for about 5 hours at about 3 SCFM/ft$^2$.

After the top layer 30 of the rubblized mass of oil shale is preheated to at least its ignition temperature, preferably to its retorting temperature and most preferably for a sufficient time to retort a substantial thickness of the rubblized shale, pilot light 42 is quenched by closing mixing valve 50 and the preheating gas is shut off by control valve 56. Immediately thereafter, control valve 56 is turned to an open ignition-gas position to permit ingress of ignition gas into the retort. The ignition gas is fed to the preheated top layer 30 of the rubblized mass of oil shale by outer nozzle 34 at a temperature from 900° F. to 1200° F., preferably about 950° F. for enhanced effectiveness, to ignite the retort and establish a generally uniform flame front 62 across the preheated layer.

The composition of the off gases emitted from the retort can be monitored to detect satisfactory ignition of the flame front 62. Satisfactory ignition generally occurs when the oxygen content by volume of the off gases emitted in the retort decreases to at least 1.5%. Once the flame front is satisfactory established, the ignition gas is turned off by shutting valve 56.

If satisfactory ignition has not occurred, the inert preheating gas or a feed gas can be fed continuously into the retort by outer nozzle 34 or pipe 22, respectively, at a lower temperature, preferably below the ignition temperature of 650° F., for about ten hours, so long as the oxygen content of the off gases remains below its flammable limit, to cool roof 16 so as to minimize roof spalling. Thereafter, the preheating step can be repeated. In lieu of repeating the preheating step, a mixture of gaseous fuel at a relatively cool temperature, preferably below 650° F., and air below its flammable limit, can be fed into the retort via inner nozzle 32 to spread the flame front 62 across the retort by secondary combustion of residual carbon (extraneous fuel) in the rubblized bed.

Figure 4:
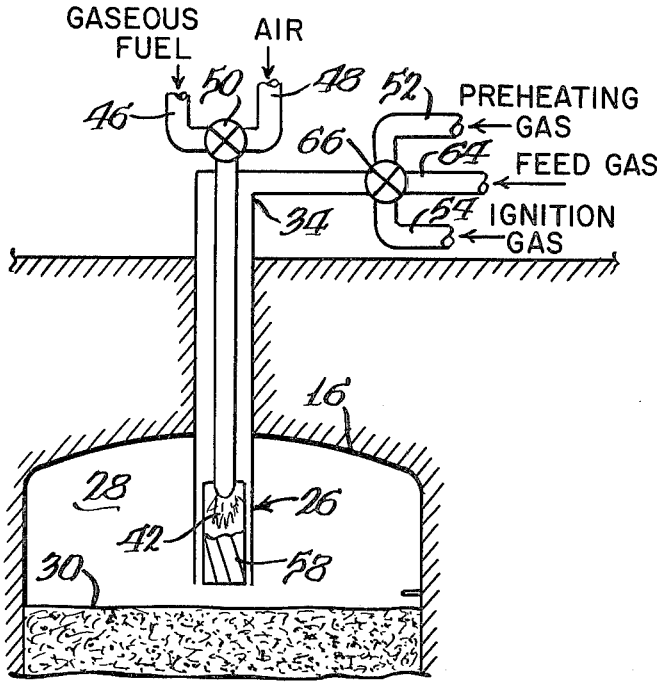
FIG. 4 is a schematic cross-sectional view of a portion of another in situ retort for carrying out the process in accordance with principles of the present invention.

In the embodiment of FIG. 4, feed gas line 64 is directly connected to a control valve 66 which permits the feed gas to be fed through the outer nozzle 34, after the ignition gas is shut off, instead of through a separate borehole or pipe 22 as shown in FIG. 1.

After the flame front 62 is established and the ignition gas turned off, feed gas valve 24 (FIG. 1) or valve 66 (FIG. 4) is opened to feed an oxygen-containing flame front-supporting feed gas, such as air into the flame front. The feed gas sustains and drives the flame front downwardly through the bed 18 of oil shale. The feed gas can be air, or air enriched with oxygen, or air diluted with steam or recycled off gas, as long as the feed gas has from 5% to less than 90% and preferably from 10% to 30% and most preferably a maximum of 20% by volume molecular oxygen. The oxygen content of the feed gas can be varied throughout the process. As long as the feed gas is supplied to the flame front, residual carbon contained in the oil shale usually provides an adequate source of fuel to maintain the flame front.

The injection pressure of the feed gas is preferably from 1 atmosphere to 5 atmospheres, and most preferably 2 atmospheres to most effectively drive the feed gas. The flow rate of the feed gas is preferably a maximum of 10 SCFM/ft$^2$, and most preferably from 1.5 SCFM/ft$^2$ to 3 SCFM/ft$^2$ for enhanced retorting efficiency.

Flame front 62 emits combustion off gases and generates heat which moves downwardly ahead of the flame front and heats the raw, unretorted oil shale in retorting zone 68 to a retorting temperature from 900° F. to 1200° F. to retort and pyrolyze the oil shale in the retorting zone. During retorting, hydrocarbons are liberated from the raw oil shale as a gas, vapor, mist or liquid droplets and most likely a mixture thereof. The liberated hydrocarbons of light gases and normally liquid shale oil flow downward, condense and liquefy upon the cooler, unretorted raw shale below the retorting zone.

During the process, retorting zone 68 moves downward leaving a layer or band 70 of retorted shale containing residual carbon. Retorted shale layer 70 above retorting zone 68 defines a retorted zone which is located between retorting zone 68 and the flame front of combustion zone 72. Residual carbon in the retorted shale is combusted in combustion zone 72 leaving spent, combusted shale in a spent shale zone 74.

Off gases emitted during retorting include various amounts of hydrogen, carbon monoxide, carbon dioxide, ammonia, hydrogen sulfide, carbonyl sulfide, oxides of sulfur and nitrogen and low molecular weight hydrocarbons. The composition of the off gas is dependent on the composition of the feed gas.

The effluent product stream of liquid oil, water, and off gases mixed with light gases and steam emitted during retorting, flow downward to the sloped bottom 76 of retort 10 and then into a collection basin and separator 70, also referred to as a "sump" in the bottom of access tunnel 20. Concrete wall 80 prevents leakage of off gas into the mine. The liquid shale oil, water and gases are separated in collection basin 82 by gravity and pumped to the surface by pumps 84, 86, and 88, respectively, through inlet and return lines 89, 90, 91, 92, 93, and 94, respectively.

Raw off gases can be recycled as part of the preheating gas, gaseous fuel or feed gas, either directly or after light gases and oil vapors contained therein have been stripped away in a quench tower or stripping vessel.

While vertical retorts are preferred, horizontal and irregular retorts can also be used. Furthermore, while it is preferred to preheat and commence ignition adjacent the top portion of the rubblized bed of oil shale in a modified in situ retort, it may be desirable in some circumstances to preheat and commence ignition adjacent at other portions of the rubblized bed or at the top or at other locations of a true in situ retort.

Among the many advantages of the above process are:

1. Greater retorting efficiency.
2. Improved product yield.
3. Enhanced uniformity of the flame front.
4. Lower operating costs.
5. Better reliability of ignition start-up.
6. Less loss of product oil.
7. Fewer oil fires.
8. Decreased carbonate decomposition and thermal cracking of the effluent shale oil.

Although embodiments of this invention have been shown and described, it is to be understood that various modifications and substitutions, as well as rearrangements and combinations of process steps, can be made by those skilled in the art without departing from the novel spirit and scope of this invention.

What is claimed is:

1. A process for retorting oil shale, comprising the steps of:

positioning a downhole burner in a space between a roof and a rubblized mass of oil shale in an underground retort, said downhole burner having a central ejector having a central nozzle and an annular ejector positioned generally cocentrically about said central ejector;

ejecting a retorting gas comprising a substantially inert preheating gas selected from the group consisting essentially of nitrogen, steam, and retort off gases, from said annular ejector onto said rubblized mass for a sufficient time to preheat an upper portion of said rubblized mass to a temperature of at least 650° F. while substantially preventing said retorting gas from being ignited into a flame front by substantially preventing air and molecular oxygen from being discharged from said downhole burner while said retort gas is being ejected from said downhole burner onto said rubblized mass;

establishing a pilot light sustained by a mixture of gaseous fuel selected from the group consisting essentially of methane, retort off gases, and shale oil, and a sufficient amount of molecular oxygen to ignite said gaseous fuel in said central ejector, said retorting gas being heated by said pilot light;

terminating said retorting gas and said pilot light when said upper portion of said rubblized mass has been preheated by said retorting gas to a temperature of at least 650° F.;

establishing a flame front generally across said retort by ejecting a flame front-supporting gas containing from 5% to 90% by volume molecular oxygen from said annular ejector onto said heated portion of said rubblized mass of oil shale at a temperature from 900° F. to 1200° F., and driving said flame front generally downwardly through said mass of oil shale with said flame front-supporting gas to liberate shale oil and light hydrocarbon gases from said oil shale.

2. A process for retorting oil shale in accordance with claim 1 wherein said gaseous fuel is mixed with air.

3. A process for retorting oil shale in accordance with claim 32 wherein said downhole burner has longitudinally offset baffles positioned below said nozzle of said central ejector and said retorting gas and said ignited gaseous fuel are mixed together in a generally turbulent manner by said baffles at a location positioned downstream and below said central nozzle.

4. A process for retorting oil shale in accordance with claim 1 wherein said heated portion is retorted by said retorting gas to liberate hydrocarbons from said oil shale leaving retorted shale containing carbon residue and said carbon residue serves as fuel for said flame front.

5. A process for retorting oil shale in accordance with claim 32 wherein said flame front-supporting gas is air.

6. A process for retorting oil shale in accordance with claim 1 including injecting said retorting gas downwardly from said annular ejector onto said rubblized mass at a rate from 2 SCFM/ft$^2$ to 3 SCFM/ft$^2$, monitoring the oxygen content of the off gases emitted from the retort during retorting, and shutting off said flame front-supporting gas when the oxygen content of said off gases emitted from said retort decreases to at least 1.5% by volume.

7. A process for retorting oil shale in accordance with claim 1 wherein said retorting gas is nitrogen.

8. A process for retorting oil shale in accordance with claim 1 wherein said retorting gas is ejected at about 950° F.

9. A process for retorting oil shale in accordance with claim 1 wherein said flame front-supporting gas is ejected at about 950° F.

10. A process for retorting oil shale in accordance with claim 1 including minimizing spalling of said roof by injecting said retorting gas downwardly from said annular ejector at a temperature substantially lower than 650° F. prior to termination.

11. A process for retorting oil shale in accordance with claim 10 wherein said retorting gas is injected downwardly from said annular ejector at about 250° F. for about 5 hours at about 3 SCFM/ft$^2$.

* * * * *

UNITED STATES PATENT OFFICE

CERTIFICATE OF CORRECTION

Patent No. 4,425,967 Dated January 17, 1984

Inventor(s) HOEKSTRA, GERALD B.

It is certified that error appears in the above-identified patent and that said Letters Patent are hereby corrected as shown below:

| Patent Column | Line | | |
|---|---|---|---|
| 9 | 2 | " 32 " | should be -- 1 -- |

Signed and Sealed this

*Fifteenth* Day of *May 1984*

[SEAL]

*Attest:*

GERALD J. MOSSINGHOFF

*Attesting Officer*

*Commissioner of Patents and Trademarks*